US005998914A

United States Patent [19]

Kohne et al.

[11] Patent Number: 5,998,914

[45] Date of Patent: Dec. 7, 1999

[54] ELECTRODELESS GAS DISCHARGE LAMP ASSEMBLY AND METHOD OF MANUFACTURE

[75] Inventors: Robert L. Kohne, Noblesville; Jack D. Bodem, Jr., Kokomo, both of Ind.

[73] Assignee: Federal-Mogul World Wide, Inc., Southfield, Mich.

[21] Appl. No.: 09/165,927

[22] Filed: Oct. 2, 1998

[51] Int. Cl.[6] ..... H01J 1/50

[52] U.S. Cl. ..... 313/161; 313/160; 313/607; 445/23

[58] Field of Search ..... 313/160, 161, 313/607; 315/248, 344; 445/23

[56] References Cited

U.S. PATENT DOCUMENTS

| | | |
|---|---|---|
| Re. 34,492 | 12/1993 | Roberts . |
| 1,689,485 | 10/1928 | Hendry . |
| 1,807,933 | 6/1931 | Roehrich . |
| 1,816,619 | 7/1931 | Smith . |
| 1,878,247 | 9/1932 | Beck . |
| 2,102,189 | 12/1937 | Barclay . |
| 2,118,437 | 5/1938 | Kayatt . |
| 2,774,905 | 12/1956 | Hansen . |
| 2,776,391 | 1/1957 | Peek, Jr. . |
| 2,966,601 | 12/1960 | Peek, Jr. . |
| 3,504,339 | 3/1970 | Bailey . |
| 4,206,387 | 6/1980 | Kramer . |
| 4,950,059 | 8/1990 | Roberts . |
| 5,866,991 | 2/1999 | Farkas et al. ..... 313/154 |

*Primary Examiner*—Vip Patel
*Assistant Examiner*—Todd Reed Hopper
*Attorney, Agent, or Firm*—Jon E. Shackelford; Reising, Ethington, Barnes, Kisselle, Learman & McCulloch, P.C.

[57] ABSTRACT

An electrodeless gas discharge lamp assembly (10) includes a light-transmitting envelope (12) having an illumination gas (14) sealed therein. An induction coil (24) is disposed about the envelope (12) and is operative when driven to excite the gas (14) to inductive discharge illumination. The coil (24) and envelope (12) are prepared as separate components. The coil (24) has an inner circumference which is initially smaller in dimension than a fixed outer circumference of the envelope (12). The two are assembled by extending the envelope (12) into the coil (24). The envelope (12) expands the inner circumference of the coil (24) to the size of the envelope (12), achieving a constricted, intimate contact of the coil (24) about the envelope (12) and assuring that the flux lines generated by the coil (24) will pass through the envelope (12) and act on the gas (14).

9 Claims, 1 Drawing Sheet

FIG-1
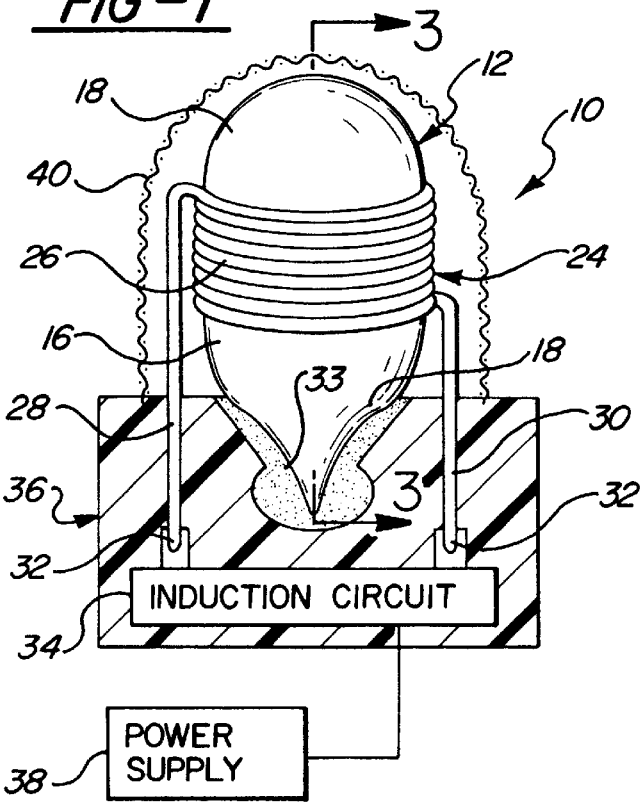
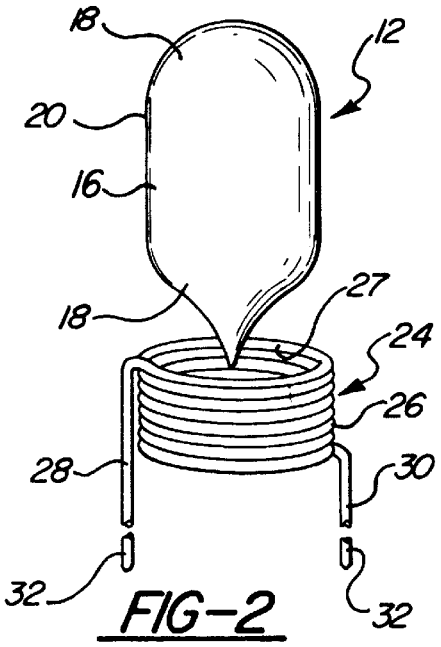
FIG-2
FIG-4
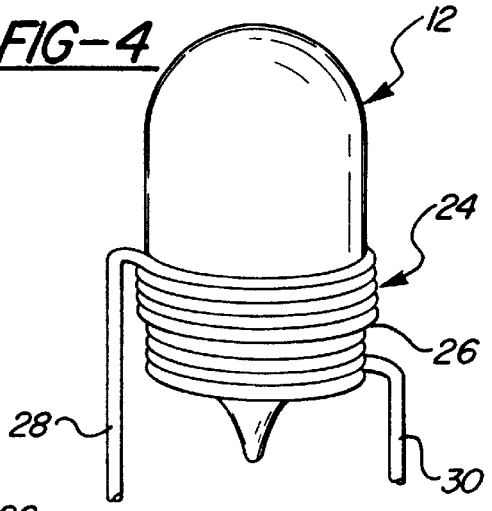
FIG-3
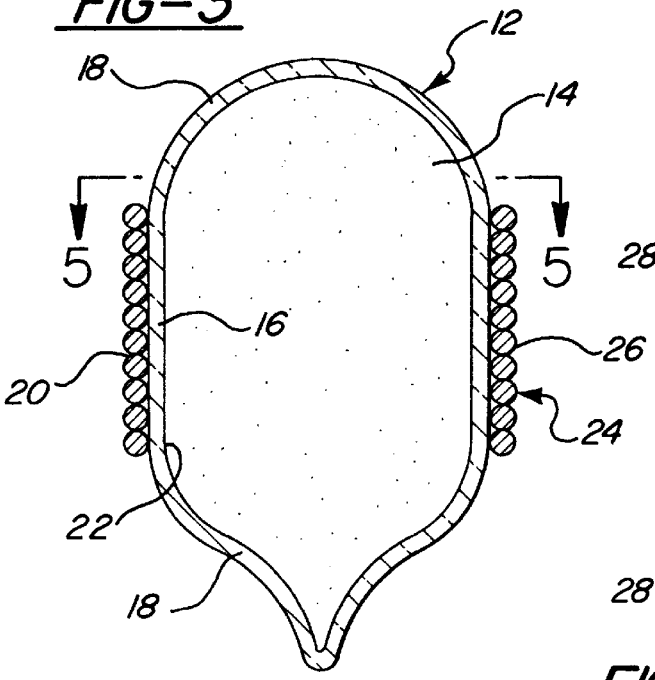
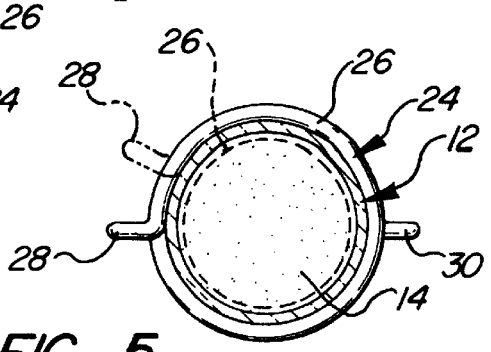
FIG-5

ELECTRODELESS GAS DISCHARGE LAMP ASSEMBLY AND METHOD OF MANUFACTURE

BACKGROUND OF THE INVENTION

1. Technical Field

This invention relates generally to inductively energized electrodeless gas discharge lamps and more particularly to the manufacture and assembly of the sealed envelope and the surrounding external induction coil of such lamps.

2. Related Prior Art

Electrodeless gas discharge lamp assemblies are well known in which a gas, such as neon, is sealed within a light-transmitting envelope of quartz or the like and surrounded by an external induction coil. The coil, when energized, excites the gas to discharge illumination.

The coil of such assemblies is often larger in diameter than that of the envelope such that a gap exists between the envelope and coil. Such gap can be eliminated by disposing the coil in intimate contact with the outer surface of the envelope. Known techniques for achieving such intimate contact of the coil include winding a strand of copper wire or the like about the envelope or printing a metallic coil pattern on the outer surface of the envelope. Direct engagement between the coil and envelope minimizes any losses of inductance that may be attributed to the presence of gap, since the flux lines generated by the coil are sure to pass through the envelope and avoid any gap.

The winding of the coil about the envelope requires special fixturing to support the envelope and adds a costly manufacturing step to the assembly process. Screen printing the coil onto the envelope likewise requires special, costly printing equipment and techniques and introduces a manufacturing step to the assembly process. This invention is directed toward providing a more efficient, cost-effective approach to preparing and assembling the envelope and coil to achieve the desired close contact therebetween.

SUMMARY OF THE INVENTION AND ADVANTAGES

A method of making an electrodeless inductively energized gas discharge lamp assembly comprises preparing a light-transmitting envelope having a fixed outer circumference and a gas sealed within the envelope inductively excitable to discharge illumination. An induction coil is prepared having a helically coiled section with an inner circumference that is initially smaller than the outer circumference of the envelope. The envelope is extended into the coil and the circumference of the coil enlarged to the size of the envelope to provide intimate engagement of the coil about the envelope.

Prefabricating the coil simplifies the assembly process with the envelope by eliminating the manufacturing step making the coil by winding it or printing it onto the envelope and the associated cost and complexity of the special equipment and techniques required for producing a coil in such manner. All that is required to assemble the coil and envelope according to the invention is simply extending the envelope into the pre-wound coil. The result is an assembly in which the coil is tightly wound and preferably constricted about the envelope to ensure optimum performance of the coil.

DETAILED DESCRIPTION OF THE DRAWINGS

These and other features and advantages of the present invention will become more readily appreciated by those skilled in the art when considered in connection with the following detailed description and drawings, wherein:

FIG. 1 is a diagrammatic perspective view of a gas discharge lamp assembly according to the invention;

FIG. 2 is a perspective view of the envelope and coil components prior to their assembly;

FIG. 3 is a cross-sectional view taken generally along lines 3—3 of FIG. 1;

FIG. 4 is a view like FIG. 2 but illustrating the insertion of the envelope into the coil; and FIG. 5 is a cross-sectional view taken along lines 5—5 of FIG. 4.

DETAILED DESCRIPTION

An electrodeless gas discharge illumination assembly constructed according to a presently preferred embodiment of the invention is indicated generally at 10 in the drawings and comprises a gas envelope 12 fabricated of a light-transmitting substance such as quartz or the like. A volatile gaseous fill medium 14 is sealed within the envelope 12 and is of the type which illuminates to provide a light source upon discharge excitation from an induction source. Several known fill materials may be used as the gaseous medium, including neon gas, mercury, xenon and the like.

The envelope 12 has a generally cylindrical main body closed at each end by end portions 18. The body 16 has an outer surface 20 that is preferably generally cylindrical in shape, as illustrated in the drawings, defining a predetermined fixed outer circumference and associated diameter of the envelope 12. While the cylindrical shape of the body 16 is preferred, the invention contemplates envelopes of shapes other than cylindrical which may include rectangular, U-shaped, ring-shaped, dome-shaped, or irregular shapes that nonetheless would have a fixed circumference for engaging a surrounding induction coil at the radially outermost extremities of the envelope. Thus, the envelope is not to limited to any particular shape for purposes of the invention.

It will be seen from FIG. 3 that the envelope 12 is "electrodeless", in that it lacks an electrode within the sealed environment or interior 22 of the envelope in which the gas 14 is contained.

The assembly 10 further includes an induction coil 24 fabricated of an electrically conductive material, such as copper or the like that, while generally ductile, also exhibits at least a small amount of resiliency when coiled into a spring shape. The coil 24 includes a helically coiled mid-section 26 comprised of a plurality helically disposed winds of the coil terminating at its opposite ends in a pair of legs 28, 30. The legs 28, 30 are formed with mounting terminals 32, such as pin terminals, at their ends for securing the legs 28, 30 of the coil 24 to an induction circuit 34 of a lamp base 36 of the assembly 10 as illustrated diagrammatically in FIG. 1. The induction circuit 34 is in turn coupled to an external power supply 38 that powers the induction circuit 34 and coil 24 to induce a high frequency field within the envelope 12 of such character to excite the gas 14 to glow discharge illumination. The coil 24 and circuit 34 preferably generate RF signals in the form of flux lines that pass through the envelope 12 to effect the discharge illumination of the gas 14 according to known principles. An RF screen 40 is secured to the base 36 and extends about the envelope 12 and coil 24 to contain RF emissions. The base 36 is likewise shielded as is known to prevent RF emissions through the base 36.

The coil 24 and envelope 12 are constructed in a manner that enables the coil 24 to fit snugly about the envelope 12. According to the invention, the envelope 12 and coil 24 are formed as separate prefabricated components, as illustrated in FIG. 2. The coiled midsection 26 has an inner circumference that is initially smaller in size than the outer circumference of the envelope 12 such that it is necessary to enlarge the coil 24 in order to receive the envelope 12 into the coil 24, which may also be appreciated from FIG. 2 which illustrates the coil 24 as being relatively smaller in diameter than the envelope 12.

FIG. 4 illustrates the assembly of the envelope 12 and coil 24. As shown, the envelope 12 is extended into the relatively smaller coil 24 which brings the outer surface 20 of the envelope 12 into engagement with the inner surface 27 of the coil 24, exerting a radially outward force on the coil 24. The coil 24 responds to such force by displacing the legs 28, 30 circumferentially in the direction of unwinding of the coiled midsection 26. Such unwinding effectively enlarges the inner diameter and thus circumference of the coil 24 to the size of the envelope to achieve close, intimate contact between the coil 24 and envelope 12. The coil 24 preferably has at least some amount of resiliency such that the coiled section 26 acts like a spring to maintain a constant recoil or return force causing the coil 24 to constrict about the envelope 12 once installed. In this way, a close, snug fit is achieved between the coil 24 and envelope 12 eliminating any gap therebetween and assuring inductive flex lines generated by the coil 24 are directed through the interior of the envelope 12 so as to contribute to exciting the gas 14, rather than taking a path through a gap between the coil and envelope. FIG. 5 shows the coil 24 in solid lines in its enlarged state constricted about the envelope 12. The broken chain line position of the coil 24 represents the pre-assembled, relaxed state of the coil 24 in which the circumference and thus the diameter are relatively smaller than the envelope 12. FIG. 5 further illustrates the legs 28, 30 as being displaced relative to one another in the direction of unwinding from the broken chain line position to the final solid line position to accommodate the enlargement of the coil 24. For ease of assembly, the legs 28, 30 may be manually displaced in the direction of unwinding by an applied force to assist the installation of the envelope 12 into the coil 24. In other words, the method of the invention contemplates relying entirely upon the axial insertion of the envelope 12 into the coil 24 to exert the necessary radially outward expansion force on the coil 24, or relying partially or entirely on application of an external coil-unwinding force on the coil 24 to enlarge the coil 24 sufficiently to receive the envelope 12.

The assembled envelope 12 and coil 24 may thereafter be mounted to the lamp base 36 by any suitable means. As mentioned, the legs 28, 30 of the coil 24 are preferably formed with mounting terminals 32 which enable the coil 24 to plug into a mating connection of the induction circuit 34. The envelope 12 may likewise be mounted by any suitable means to the lamp base 36, such as by setting the envelope 12 in an insulating pot or compound 33 or by suitable mechanical means.

Various treatments may be carried out on the coil 24, depending upon its composition, to achieve the desired resiliency. For instance, in the event copper is selected as the coil material, it may be desirable to temper the copper to impart greater shape memory to the coil and thus enhance its ability to constrict about the envelope 12.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A method of making an electrodeless inductively energized gas discharge lamp assembly comprising:

preparing a light-transmitting envelope having a fixed outer circumference and a gas sealed within the envelope inductively excitable to discharge illumination;

preparing an induction coil having a helically coiled section with an inner circumference that is initially smaller than the outer circumference of the envelope; and extending the envelope into the coil and enlarging the circumference of the coiled section to that of the envelope to provide direct intimate contact between the coil and envelope.

2. The method of claim 1 wherein the circumference of the coiled section is enlarged by action of extending the envelope into the coil.

3. The method of claim 2 wherein the coiled section is resilient and imparts a constricting force of the coiled section about the envelope.

4. The method of claim 1 wherein the coil includes opposite ends at least one of which is free and displaced radially of the other end upon the expansion of the coiled section.

5. The method of claim 1 including coupling the assembled coil and envelope to a lamp base.

6. The method of claim 1 wherein the coil is enlarged by action of the insertion of the envelope into the coil.

7. The method of claim 1 wherein the coil is enlarged by application of an external coil-unwinding force on the coil.

8. A method of making an electrodeless inductively energized gas discharge lamp assembly comprising:

preparing a light-transmitting envelope having a fixed outer circumference and including a gas sealed within the envelope inductively excitable to discharge illumination;

preparing an induction coil having a helically coiled section with an inner circumference that is initially smaller than the outer circumference of the envelope and opposite ends extending from the coiled section; and supporting the coil while extending the relatively larger envelope into the coil bringing an outer surface of the envelope into engagement with an inner surface of the coiled section and displacing the opposite ends relatively radially of one another causing the inner circumference of the coiled section to enlarge to the size of the envelope to achieve intimate constricting engagement of the coil about the envelope.

9. An electrodeless inductively energized gas discharge lamp assembly comprising:

a light-transmitting envelope having a fixed outer circumference and a gas sealed within the envelope inductively excitable to discharge illumination; and characterized by an induction coil having a helically coiled section with an inner circumference that is initially smaller than the outer circumference of the envelope, said coil being disposed about said envelope with said coiled section enlarged to the circumference of said envelope and constrictingly engaging said envelope.

* * * * *